US008128479B2

(12) United States Patent
Dunaevsky et al.

(10) Patent No.: US 8,128,479 B2
(45) Date of Patent: Mar. 6, 2012

(54) ACCUMULATION OF BONUS POINTS IN A GAMBLING GAME

(75) Inventors: Vladimir Dunaevsky, Toronto (CA); Serge Bourenkov, Toronto (CA)

(73) Assignee: Cryptologic Inc., Toronto (CA)

( * ) Notice: Subject to any disclaimer, the term of this patent is extended or adjusted under 35 U.S.C. 154(b) by 1980 days.

(21) Appl. No.: 10/641,680

(22) Filed: Aug. 15, 2003

(65) Prior Publication Data

US 2005/0037838 A1 Feb. 17, 2005

(51) Int. Cl.
*A63F 9/24* (2006.01)

(52) U.S. Cl. ..... 463/20; 463/16; 463/25

(58) Field of Classification Search ..... 463/25, 463/16, 20

See application file for complete search history.

(56) References Cited

U.S. PATENT DOCUMENTS

| | | | | |
|---|---|---|---|---|
| 5,833,540 | A | 11/1998 | Miodunski et al. | |
| 5,851,148 | A * | 12/1998 | Brune et al. | 463/25 |
| 5,947,820 | A * | 9/1999 | Morro et al. | 463/9 |
| 6,371,852 | B1 | 4/2002 | Acres | |
| 6,739,971 | B2 * | 5/2004 | Devaull | 463/20 |
| 6,793,578 | B2 * | 9/2004 | Luccesi et al. | 463/20 |
| 2002/0094871 | A1 | 7/2002 | Luciano, Jr. et al. | |
| 2002/0151346 | A1 | 10/2002 | Devaull | |
| 2003/0032474 | A1 | 2/2003 | Kaminkow et al. | |

FOREIGN PATENT DOCUMENTS

| | | | |
|---|---|---|---|
| CA | 2 403 034 | A1 | 3/2003 |
| CA | 2 463 246 | A1 | 4/2003 |
| WO | WO 98/15928 | * | 4/1998 |

OTHER PUBLICATIONS

International Search Report, 6 pages.

* cited by examiner

*Primary Examiner* — Omkar Deodhar
(74) *Attorney, Agent, or Firm* — Bereskin & Parr LLP

(57) ABSTRACT

A dedicated gaming device or an on-line game is described wherein the player first plays a primary game. For certain outcomes of the primary game, the player accumulates a bonus point. The player accumulates the bonus points until a certain number of bonus points are accumulated. The player then wins the bonus associated with those bonus points. Accordingly, the player has an incentive to keep playing the on-line game or dedicated gaming machine to make use of the accumulated bonus points that lead to a bonus award. In a further embodiment, a player logs onto the on-line gaming site or begins play of a dedicated gaming machine, and the accumulated bonus points from the player's last game before cashing out is displayed for the current session. Accordingly, the player resumes play with all the accumulated bonus points from the previous session. This provides an incentive for the player to return to the same game whether in a casino or on-line.

14 Claims, 4 Drawing Sheets

ACCUMULATION OF BONUS POINTS IN A GAMBLING GAME

FIELD OF THE INVENTION

This invention relates to gaming and, in particular, to a bonus game.

BACKGROUND OF THE INVENTION

With the advent of video gaming machines, including on-line gaming, virtually any type of gambling game is possible to display and play. Many gaming devices include, as a primary game, video or mechanical reels with symbols. Upon achieving a certain winning symbol combination, a bonus game is then initiated. The bonus game may be a video game or other type of game. Such gaming machines are very popular due to the added excitement and generally high payoffs of the bonus games.

What is needed is a game, whether played on a dedicated gamine device or on a general purpose computer during on-line game, that creates increased player interest so that the player plays for a longer time and seeks out the same game whenever the player returns to the casino or to the on-line gaming site.

SUMMARY

A gambling game is described wherein the player first plays a primary game. The game may be played on a stand-alone gaming device, a group of devices connected to a server, a computer playing an on-line game, or on any other suitable gaming device. The primary game may be a video or mechanical reel-type game or any other type of game. For certain outcomes of the primary game, the player accumulates one or more bonus points. The bonus points are displayed on a display screen in any manner. In one embodiment, each bonus point causes a star to be displayed along a path leading to a bonus win. The player accumulates the bonus points (stars) along the path until the path is complete and, as a result, the player wins the bonus associated with that path. Each path may be associated with a particular symbol combination.

Accordingly, the player has an incentive to keep playing the machine to make use of the accumulated bonus points that lead to a bonus award.

In a further embodiment, a player logs onto the on-line gaming site or begins play of a dedicated gaming machine, and the accumulated bonus points from the player's last game before cashing out is displayed for the current session. Accordingly, the player resumes play with all the accumulated bonus points from the previous session. This provides an incentive for the player to return to the same game whether in a casino or on-line.

The player may log onto a gaming site using a standard registration protocol at the beginning of an on-line gaming session, and the player's last game status is recalled based on any player information. For a stand-alone gaming machine or a group of machines connected to a server, the player may be identified by the player using a player tracking card, a keypad, or any other form of player ID input. A central server in the casino or a game server for on-line gaming stores the status of the bonus points from the player's previous session, and the status is recalled from a memory using the player's ID or other information. Any gaming machine on the casino floor capable of playing the bonus game can retrieve the information from the central server.

Any other types of displays for accumulating bonus points may be used instead of the bonus path described above. For example, instead of a bonus path, counters may be incremented or any other game may be played.

DETAILED DESCRIPTION

Figure 1:
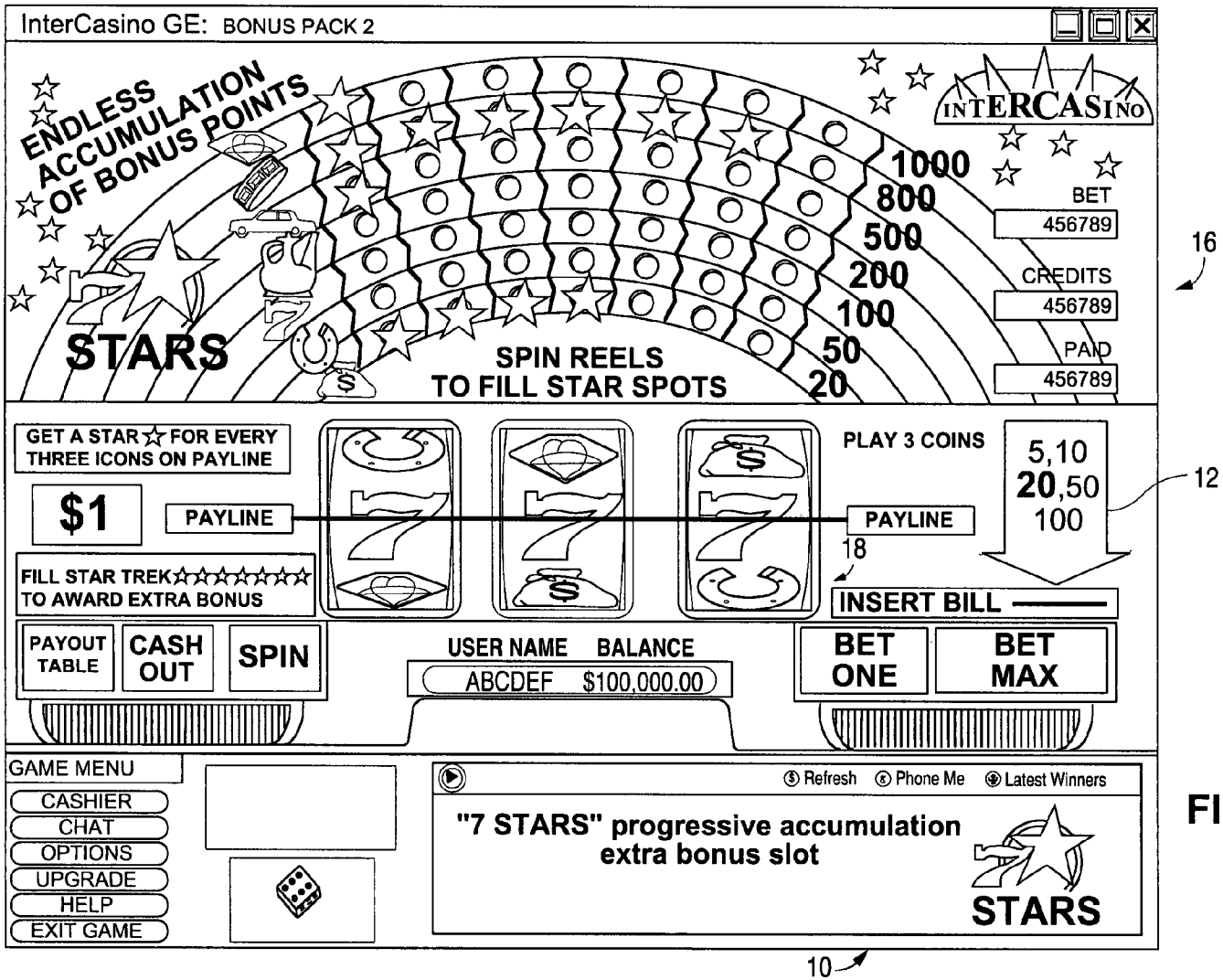
FIG. 1 is a display on a video screen, which may be in a dedicated gaming machine or a player's monitor connected to a home computer, showing a game being played after bonus points have been accumulated.

FIG. 1 is a display on a video screen 10 during a game in accordance with one embodiment of the invention. Screen 10 may be a screen on a home computer or may be a screen on an actual slot machine. In one embodiment, a player controls the game using a mouse (or other pointing device) and a cursor to point to virtual buttons on the display screen 10. Physical buttons or a touch screen may also be used.

Figure 2:
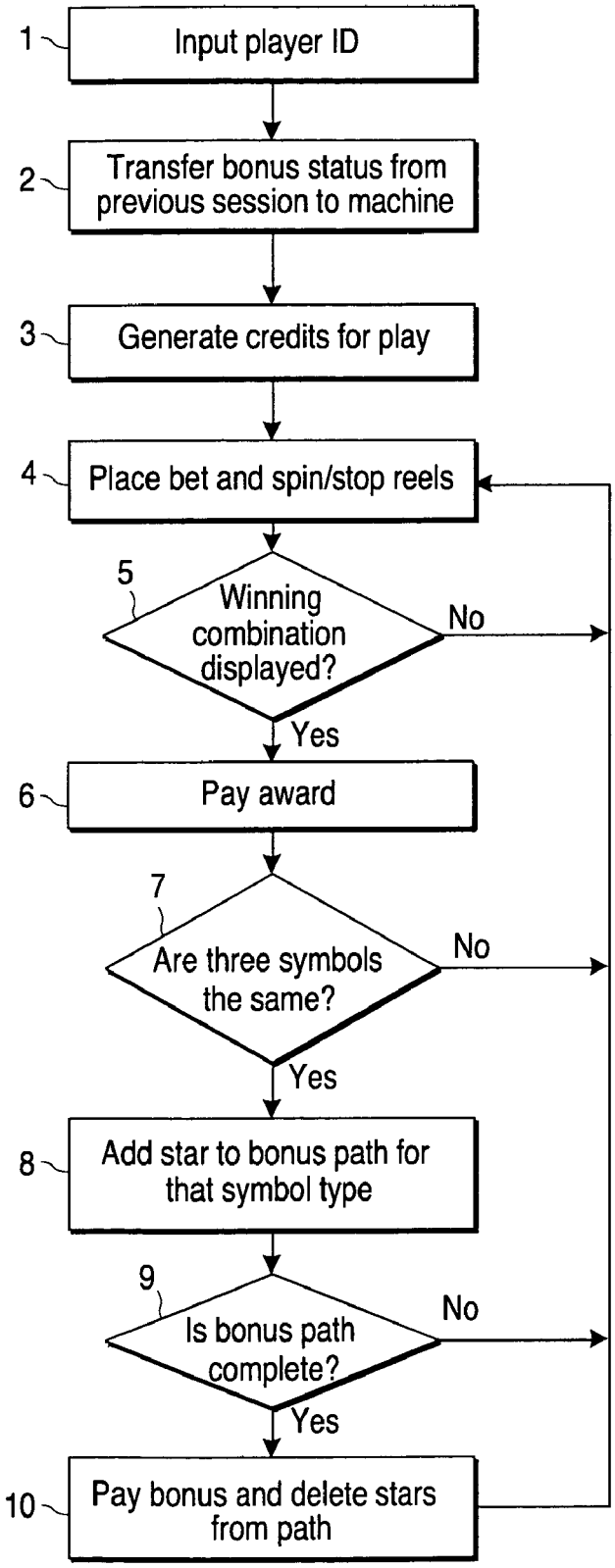
FIG. 2 is a flowchart illustrating steps for carrying out one embodiment of the invention.

In step 1 of the flowchart of FIG. 2, a player inputs the player's identification (ID) to the appropriate processor, such as a game server for on-line gaming, a central server in a casino, or a processor in a slot machine. Transmitting player ID information in a gaming environment is conventional. The player ID may consist of any type of code that identifies the player. For on-line gaming, entering the player's name via the keyboard along with a password will typically be sufficient to identify the player. For a dedicated gaming machine, a player tracking card having a magnetic strip may be inserted into the gaming machine, where the player ID is encoded in the magnetic strip.

In step 2, the player ID is then used to address a memory, which stores the status of the last gaming session played by the player. The memory may be in a server or in a stand-alone gaming machine. This status identifies the accumulated bonus points (to be described later) and any other suitable information from the last session. The stored game status from the previous session is transferred to the gaming device being played.

In step 3, if credits have not already been stored during the previous session, the player generates credits in the machine for playing during the current session. For on-line gaming, the player's credits may be purchased from the player's credit card, debit card, player account, or by any other means. The player may click on an amount to be withdrawn from the player's account from the amounts shown in area 12 of FIG. 1 including $5, $10, $20, $50, and $100. Credits available for play are then displayed on a meter 16.

In step 4, the player may then click on the "Bet One" or "Bet Max" button using a pointing device to play the game. The player then clicks on the spin button to spin the three reels 18. The three reels 18 randomly stop to display three symbols across a payline. More than one payline may be used, although only a center payline is shown in FIG. 1.

In step 5, the game server (or other processor) determines whether the combination is a winning symbol combination that pays credits. If not, no award is paid and the player must place another bet to continue playing. If the combination displayed is a winning combination (as determined by a look-up pay table), then, in step 6, the award for the displayed winning symbol combination is paid to the player.

In step 7, it is further determined if the symbols across the payline are three of the same symbols. If the three symbols are the same, then, in step 8, the player gets a bonus point, displayed in the upper portion of screen 10 as a star. For each set of three symbols, there is a path of seven steps that leads to a bonus award associated with that set of symbols. Awarding a bonus point causes the next step leading to the bonus award to become a star. The displayed bonus points may have been accumulated in one or more previous sessions. In the example of screen 10, the reels 18 display a set of three sevens, which will add a star in the first step in the "seven" path.

In step 9, it is determined by the processor whether the additional bonus point has completed a bonus path. If a bonus path was completed, such as if the player had hit a set of three rings in the example of screen 10, then the bonus associated with completion of that bonus path is credited to the player (step 10), and the bonus points for that path are extinguished. The bonus awards for each path are identified in screen 10 at the end of each path. The amount of the bonus award is related to the probability of three symbols of that kind occurring.

At the end of a session, the player presses the cash out button, whereby the player's credits and accumulated points are stored in the game server memory (or other memory), and the session is ended. If the game is played is on a dedicated machine, pressing the cash out button will cause the machine to pay the player with coins or with other means.

When the player goes back to the on-line gaming site, the player will want to play the same type of game to make use of her accumulated bonus points.

The particular display of the game may take any form. For example, any combinations of symbols may generate a bonus point. The bonus points may simply be a numeric value displayed by a counter. Any other technique of presenting bonus points may also be used.

Figure 3:
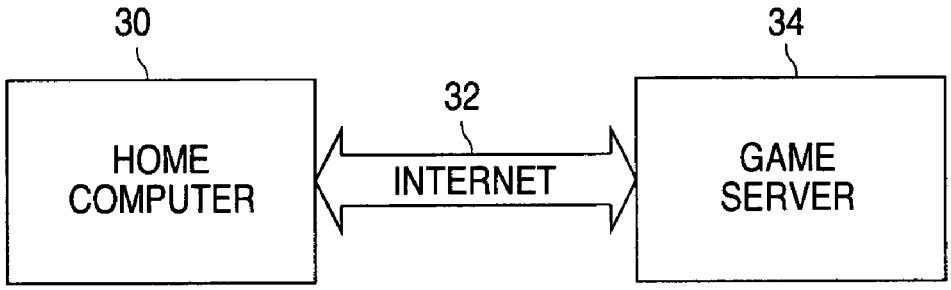
FIG. 3 illustrates the invention as a game played on-line between a home computer and a remote game server.

FIG. 3 illustrates the embodiment where screen 10 is a monitor for a home computer 30 communicating via the Internet 32 with a game server 34.

Figure 4:
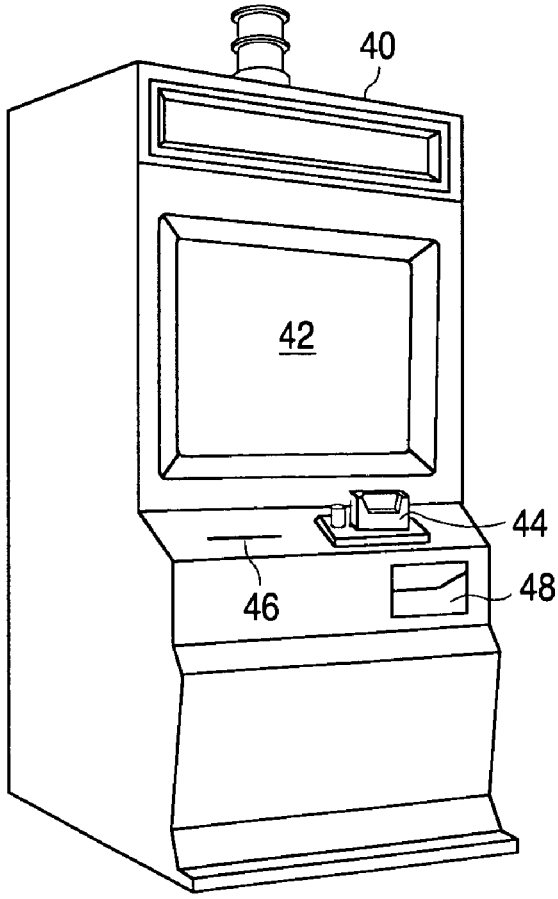
FIG. 4 illustrates a gaming machine that displays the inventive game.

FIG. 4 illustrates a dedicated gaming machine 40 wherein the monitor 42 displays screen 10 of FIG. 1. Machine 40 may also display mechanical reels instead of video reels. The processing may be conducted internal to machine 40 or partially external to machine 40 using a server. A coin slot 44 may receive coins for generating credits. A slot 46 may receive bills, player cards, or any other form of payment or identification. A coin tray 48 may receive coins from a coin hopper when a player cashes out. Player control may be by using a touch screen, where the player makes selections by touching virtual buttons displayed on monitor 42, or by using conventional push buttons arranged on the housing of machine 40.

When the player goes back to the casino, the player will want to play the same type of game to make use of her accumulated bonus points.

Figure 5:
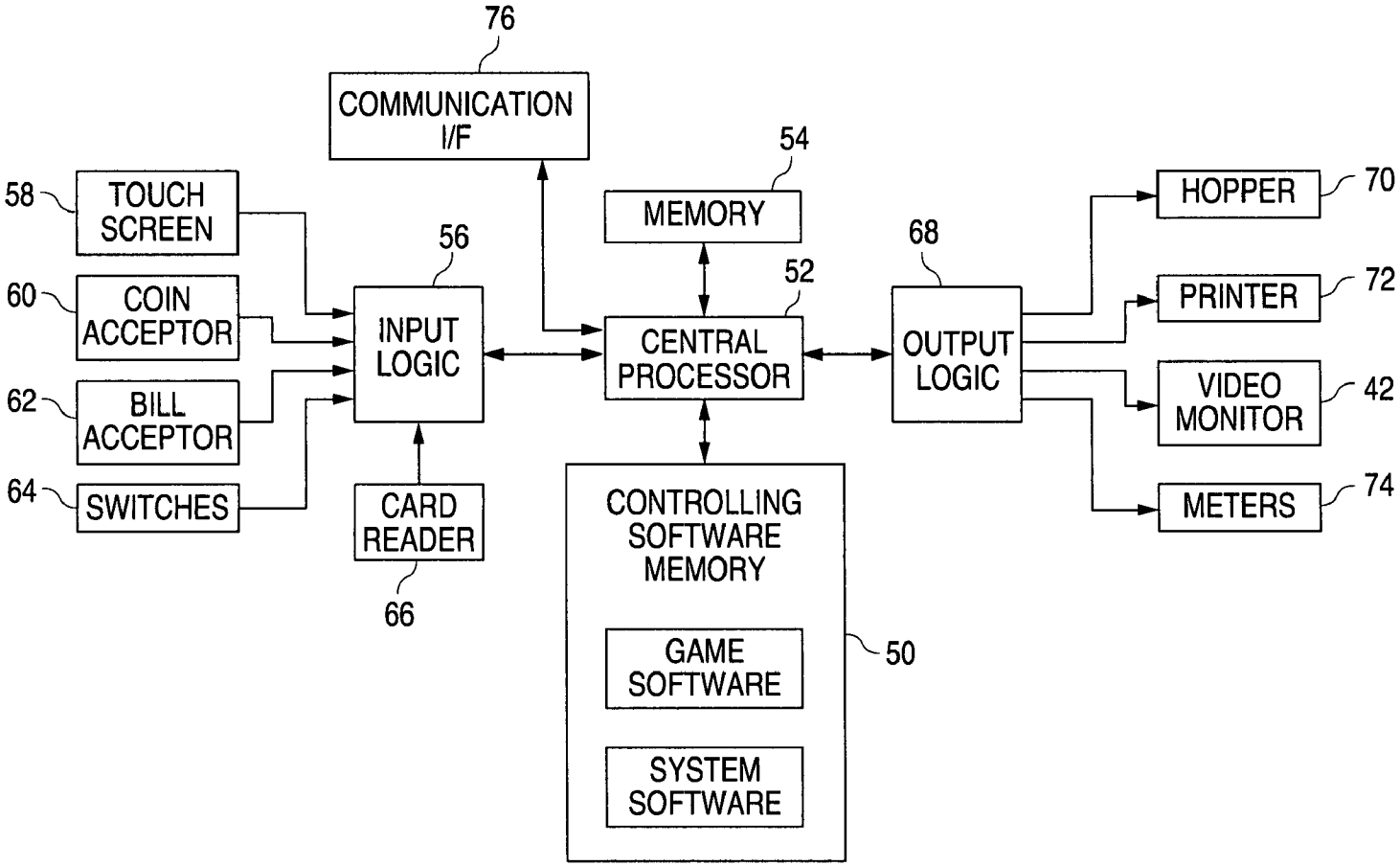
FIG. 5 illustrates various functional blocks within the gaming machine of FIG. 4.

FIG. 5 shows various functional units in a conventional gaming machine, such as machine 40. The game program is stored in a memory 50 along with system software. The system software controls non-game-specific functions similar to an operating system on a personal computer. Central processor 52 controls the game and uses conventional RAM 54. Input logic 56 receives inputs from touch screen 58, coin acceptor 60, bill acceptor 62, mechanical switches (if any) 64, and card reader 66.

Output logic 68 controls devices such as a coin hopper 70, a printer 72 (for payouts or for maintenance purposes), video monitor 42, and various meters 74.

An optional communications interface board 76 is used for connecting the gaming machine 40 with a central server. A group of gaming machines 40 may communicate with the same server.

The game may also be played on a mobile phone, interactive TV, or other device using a computer. The term computer includes one or more processing devices and peripheral devices used to carry out a game program. The term gaming device includes a dedicated gaming machine, a general purpose computer, or other computing device that can carry out a gaming program. The status of the bonus points from the previous session may be saved in the player terminal, a server memory, a mobile phone memory, a magnetic card, a smart card, or in any other medium.

Accordingly, using the present invention, the player has a stake in continued play of the machine and will desire to play the same game in subsequent sessions so as to make use of the accumulated bonus points.

Having described the invention in detail, those skilled in the art will appreciate that, given the present disclosure, modifications may be made to the invention without departing from the spirit of the inventive concepts described herein. Therefore, it is not intended that the scope of the invention be limited to the specific embodiments illustrated and described.

What is claimed is:

1. A method performed in a gambling game comprising:

receiving a player code in a current gaming session for playing a first type of game, the first type of game comprising:

playing a primary game, the primary game rotating and randomly stopping a plurality of physical or virtual reels displaying symbols of different types, winning combinations of symbols of the same type granting instant awards to the player, a plurality of the winning combinations of symbols of the same type granting one or more bonus units to the player associated with that type of symbol;

the bonus units being used in a secondary game to achieve different bonus awards, the secondary game comprising accumulating bonus units associated with different types of symbols, wherein an accumulation of a predetermined number of bonus units associated with a particular type of symbol awards the player a particular bonus award, the bonus award value being based on a probability of an associated symbol of that particular type occurring in the primary game, such that there are a plurality of different bonus award values that may be won by the player, wherein each type of symbol on a reel that can be involved in a winning combination of symbols that grants one or more bonus units to the player is associated with a particular bonus award whose value is based on the probability of the symbol of that particular type occurring in the primary game, wherein the predetermined number of bonus units associated with a particular type of symbol that is needed to obtain the associated bonus award is the same for all the symbols, and wherein the different types of symbols on the reels do not all have the same probability of occurring for each primary game;

extinguishing accumulated bonus units associated with a particular type of symbol only after the predetermined number of bonus units associated with that type of symbol necessary to win a bonus award have been accumulated;

storing accumulated bonus units associated with the different types of symbols when the player terminates a playing session;

using the player code to retrieve from a memory the accumulated bonus units from a previous gaming session; and conducting the first type of game using the accumulated bonus units from the previous gaming session.

2. The method of claim 1 wherein the main game comprises displaying spinning reels having symbols thereon, wherein symbol combinations across one or more paylines determine whether the outcome is a non-winning outcome or a bonus outcome generating bonus units.

3. The method of claim 2 wherein at least one bonus unit is generated upon the main game displaying all of the same symbols across a payline.

4. The method of claim 3 further comprising displaying the bonus units associated with each symbol type and displaying a bonus award for accumulating of a predetermined number of bonus units for a particular symbol type.

5. The method of claim 4 wherein different symbol types are associated with different bonus awards.

6. The method of claim 1 wherein the game further comprises non-bonus outcomes that pay an award.

7. The method of claim 1 wherein the bonus outcomes pay an instant award to the player.

8. The method of claim 1 wherein each bonus unit represents an increment in a progression leading to a bonus award.

9. The method of claim 8 wherein each increment appears as a step in a path leading to a bonus award.

10. The method of claim 1 further comprising initiating an on-line gaming session with a game server over the Internet to play the game.

11. The method of claim 1 further comprising receiving a player card containing the player code.

12. A device comprising:

a display screen for receiving signals from a processor for displaying images; and a processor, the processor being programmed for carrying out the process of:

receiving a player code in a current gaming session for playing a first type of game, the first type of game comprising:

playing a primary game, the primary game rotating and randomly stopping a plurality of physical or virtual reels displaying symbols of different types, winning combinations of symbols of the same type granting instant awards to the player, a plurality of the winning combinations of symbols of the same type granting one or more bonus units to the player associated with that type of symbol;

the bonus units being used in a secondary game to achieve different bonus awards, the secondary game comprising accumulating bonus units associated with different types of symbols, wherein an accumulation of a predetermined number of bonus units associated with a particular type of symbol awards the player a particular bonus award, the bonus award value being based on a probability of an associated symbol of that particular type occurring in the primary game, such that there are a plurality of different bonus award values that may be won by the player, wherein each type of symbol on a reel that can be involved in a winning combination of symbols that grants one or more bonus units to the player is associated with a particular bonus award whose value is based on the probability of the symbol of that particular type occurring in the primary game, wherein the predetermined number of bonus units associated with a particular type of symbol that is needed to obtain the associated bonus award is the same for all the symbols, and wherein the different types of symbols on the reels do not all have the same probability of occurring for each primary game;

extinguishing accumulated bonus units associated with a particular type of symbol only after the predetermined number of bonus units associated with that type of symbol necessary to win a bonus award have been accumulated;

storing accumulated bonus units associated with the different types of symbols when the player terminates a playing session;

using the player code to retrieve from a memory the accumulated bonus units from a previous gaming session; and conducting the first type of game using the accumulated bonus units from the previous gaming session.

13. A non-transitory computer usable medium containing a program code comprising instructions for carrying out a method comprising:

controlling the computer to conduct a game comprising:

playing a primary game, the primary game rotating and randomly stopping a plurality of physical or virtual reels displaying symbols of different types, winning combinations of symbols of the same type granting instant awards to the player, a plurality of the winning combinations of symbols of the same type granting one or more bonus units to the player associated with that type of symbol;

the bonus units being used in a secondary game to achieve different bonus awards, the secondary game comprising accumulating bonus units associated with different types of symbols, wherein an accumulation of a predetermined number of bonus units associated with a particular type of symbol awards the player a particular bonus award, the bonus award value being based on a probability of an associated symbol of that particular type occurring in the primary game, such that there are a plurality of different bonus award values that may be won by the player, wherein each type of symbol on a reel that can be involved in a winning combination of symbols that grants one or more bonus units to the player is associated with a particular bonus award whose value is based on the probability of the symbol of that particular type occurring in the primary game, wherein the predetermined number of bonus units associated with a particular type of symbol that is needed to obtain the associated bonus award is the same for all the symbols, and wherein the different types of symbols on the reels do not all have the same probability of occurring for each primary game;

extinguishing accumulated bonus units associated with a particular type of symbol only after the predetermined number of bonus units associated with that type of symbol necessary to win a bonus award have been accumulated;

storing accumulated bonus units associated with the different types of symbols when the player terminates a playing session;

controlling the computer to receive a player code in a current gaming session;

controlling the computer to use the player code to retrieve from a memory the accumulated bonus units from a previous gaming session; and controlling the computer to apply the accumulated bonus units from the previous gaming session to the current session.

14. A server for carrying out a gaming program, the server comprising a processor programmed for carrying out the method comprising:

establishing communication with a local terminal for running a gaming program;

receiving a player code in a current gaming session;

using the player code to retrieve from a memory accumulated bonus units from a previous gaming session;

conducting a game using the accumulated bonus units from the previous gaming session;

the game comprising:

playing a primary game, the primary game rotating and randomly stopping a plurality of physical or virtual reels displaying symbols of different types, winning combinations of symbols of the same type granting instant awards to the player, a plurality of the winning combinations of symbols of the same type granting one or more bonus units to the player associated with that type of symbol;

the bonus units being used in a secondary game to achieve different bonus awards, the secondary game comprising accumulating bonus units associated with different types of symbols, wherein an accumulation of a predetermined number of bonus units associated with a particular type of symbol awards the player a particular bonus award, the bonus award value being based on a probability of an associated symbol of that particular type occurring in the primary game, such that there are a plurality of different bonus award values that may be won by the player, wherein each type of symbol on a reel that can be involved in a winning combination of symbols that grants one or more bonus units to the player is associated with a particular bonus award whose value is based on the probability of the symbol of that particular type occurring in the primary game, wherein the predetermined number of bonus units associated with a particular type of symbol that is needed to obtain the associated bonus award is the same for all the symbols, and wherein the different types of symbols on the reels do not all have the same probability of occurring for each primary game;

extinguishing accumulated bonus units associated with a particular type of symbol only after the predetermined number of bonus units associated with that type of symbol necessary to win a bonus award have been accumulated;

storing accumulated bonus units associated with the different types of symbols when the player terminates a playing session.

* * * * *